United States Patent [19]

Thomson

[11] Patent Number: 5,007,093

[45] Date of Patent: Apr. 9, 1991

[54] ADAPTIVE THRESHOLD VOICED DETECTOR

[75] Inventor: David L. Thomson, Warrenville, Ill.

[73] Assignee: AT&T Bell Laboratories, Murray Hill, N.J.

[21] Appl. No.: 399,357

[22] Filed: Aug. 24, 1989

Related U.S. Application Data

[63] Continuation of Ser. No. 34,298, Apr. 3, 1987, abandoned.

[51] Int. Cl.[5] ..... G10L 9/18

[52] U.S. Cl. ..... 381/46; 381/49; 381/38

[58] Field of Search ..... 364/513.5; 381/36–40, 381/43, 45, 46, 48–50

[56] References Cited

U.S. PATENT DOCUMENTS

| | | | |
|---|---|---|---|
| 3,947,638 | 3/1976 | Blankinship | 381/49 |
| 4,074,069 | 2/1978 | Tokura et al. | 381/38 |
| 4,360,708 | 11/1982 | Taguchi et al. | 381/36 |
| 4,393,272 | 7/1983 | Itakura et al. | 381/39 |
| 4,472,747 | 9/1984 | Schwartz | 360/32 |
| 4,559,602 | 12/1985 | Bates, Jr. | 364/487 |
| 4,592,085 | 5/1986 | Watari et al. | 381/43 |
| 4,625,327 | 11/1986 | Sluijter et al. | 381/49 |
| 4,791,671 | 12/1988 | Willems | 381/49 |
| 4,809,334 | 2/1989 | Bahaskar | 381/49 |

FOREIGN PATENT DOCUMENTS 149705 12/1976 Japan .

OTHER PUBLICATIONS

Gold & Rabiner, "Parallel Processing Techniques for Estimating Pitch Periods of Speech in the Time Domain", The Journal of The Acoustical Society of America, vol. 46, No. 2 (Part 2), 1969, pp. 442–448.

"Optimization of Voiced/Unvoiced Decisions in Nonstationary Noise Environments", Hidefumi Kobatake, vol. No. 1, pp. 9–18, 1/87, IEEE.

"Fast and Accurate Pitch Detection Using Pattern Recognition and Adaptive Time-Domain Analysis", D. P. Prezas et al., CH2243, pp. 109–112, 4/86, AT&T.

"Voiced/Unvoiced Calssification of Speech with Applications to the U.S. Government LPC-10E Algorithm", J. P. Campbell et al., pp. 473–476, DOD.

"Implementation of the Gold-Rabiner Pitch Detector in a Real Time Environment Using an Improved Voicing Detector", H. Hassanein et al., vol. No. 1, pp. 319–320, 2/85, IEEE.

"Long-Term Adaptiveness in a Real-Time LPC Vocoder", N. Dal Degan et al., vol. XII-No. 5, pp. 461–466, 10/84, CSELT Technical Reports.

"A Statistical Approach to the Design of an Adaptive Self-Normalizing Silence Detector", P. De Souza, vol. No. 3, pp. 678–684, 6/83, IEEE.

"A Procedure for Using Pattern Classification Techniques to Obtain a Voiced/Unvoiced Classifier", L. J. Siegel, vol. No. 1, pp. 83–89, 2/79, IEEE.

"A Pattern Recognition Approach to Voiced-Unvoiced-Silence Classification with Applications to Speech Recognition", B. S. Atal, et al., vol. No. 3, pp. 201–212, 6/76, IEEE.

*Primary Examiner*—Emanuel S. Kemeny
*Assistant Examiner*—David D. Knepper
*Attorney, Agent, or Firm*—John C. Moran

[57] ABSTRACT

Statistically analyzing a discriminant variable generated by a discriminant voiced detector is done to determine the presence of the fundamental frequency in a changing speech environment. The detector is responsive to the discriminant variable to first calculate the average of all of the values of the discriminant variable over the present and past speech frames and then to determine the overall probability that any frame will be unvoiced. In addition, the detector calculates two values, one value represents the statistical average of discriminant values that an unvoiced frame's discriminant variable would have and the other value represents the statistical average of the discriminant values for voice frames. These latter calculations are performed utilizing not only the average discriminant value but also a weight value and a threshold value which are adaptively determined from frame to frame. The unvoiced/voiced decision is made by utilizing the weight and threshold values.

11 Claims, 3 Drawing Sheets

ADAPTIVE THRESHOLD VOICED DETECTOR

This application is a continuation of application Ser. No. 034,298, filed on Apr. 3, 1987, now abandoned.

TECHNICAL FIELD

This invention relates to determining whether or not speech contains a fundamental frequency which is commonly referred to as the unvoiced/voiced decision. More particularly, the unvoiced/voiced decision is made by a two stage voiced detector with the final threshold values being adaptively calculated for the speech environment utilizing statistical techniques.

BACKGROUND AND PROBLEM

In low bit rate voice coders, degradation of voice quality is often due to inaccurate voicing decisions. The difficulty in correctly making these voicing decisions lies in the fact that no single speech parameter or classifier can reliably distinguish voiced speech from unvoiced speech. In order to make the voice decision, it is known in the art to combine multiple speech classifiers in the form of a weighted sum. This method is commonly called discriminant analysis. Such a method is illustrated in D. P. Prezas, et al., "Fast and Accurate Pitch Detection Using Pattern Recognition and Adaptive Time-Domain Analysis," Proc. IEEE Int. Conf. Acoust., Speech and Signal Proc., Vol. 1, pp. 109–112, April 1986. As described in that article, a frame of speech is declared voice if a weighted sum of classifiers is greater than a specified threshold, and unvoiced otherwise. The weights and threshold are chosen to maximize performance on a training set of speech where the voicing of each frame is known.

A problem associated with the fixed weighted sum method is that it does not perform well when the speech environment changes. The reason is that the threshold is determined from the training set which is different from speech subject to background noise, non-linear distortion, and filtering.

One method for adapting the threshold value to changing speech environment is disclosed in the paper of H. Hassanein, et al., "Implementation of the Gold-Rabiner Pitch Detector in a Real Time Environment Using an Improved Voicing Detector," IEEE Transactions on Acoustic, Speech and Signal Processing, 1986, Tokyo, Vol. ASSP-33, No. 1, pp. 319–320. This paper discloses an empirical method which compares three different parameters against independent thresholds associated with these parameters and on the basis of each comparison either increments or decrements by one an adaptive threshold value. The three parameters utilized are energy of the signal, first reflection coefficient, and zero-crossing count. For example, if the energy of the speech signal is less than a predefined energy level, the adaptive threshold is incremented. On the other hand, if the energy of the speech signal is greater than another predefined energy level, the adaptive threshold is decremented by one. After the adaptive threshold has been calculated, it is subtracted from an output of a elementary pitch detector. If the results of the subtraction yield a positive number, the speech frame is declared voice; otherwise, the speech frame is declared on unvoice. The problem with the disclosed method is that the parameters themselves are not used in the elementary pitch detector. Hence, the adjustment of the adaptive threshold is ad hoc and is not directly linked to the physical phenomena from which it is calculated. In addition, the threshold cannot adapt to rapidly changing speech environments.

SOLUTION

The above described problem is solved and a technical advance is achieved by a voicing decision apparatus that adapts to a changing environment by utilizing adaptive statistical values to make the voicing decision. The statistical values are adapted to the changing environment by utilizing statistics based on an output of a voiced detector. The statistical parameters are calculated by the voiced detector generating a general value indicating the presence of a fundamental frequency in a speech frame in response to speech attributes of the frame. Second, the mean for unvoiced ones and voiced ones of speech frames is calculated in response to the generated value. The two means are then used to determine decision regions, and the determination of the presence of the fundamental frequency is done in response to the decision regions and the present speech frame.

Advantageously, in response to speech attributes of the present and past speech frames, the mean for unvoiced frames is calculated by calculating the probability that the present speech frame is unvoiced, calculating the overall probability that any frame will be unvoiced, and calculating the probability that the present speech frame is voiced. The mean of the unvoiced speech frames is then calculated in response to the probability that the present speech frame is unvoiced and the overall probability. In addition, the mean of the voiced speech frame is calculated in response to the probability that the present speech frame is voiced and the overall probability. Advantageously, the calculations of probabilities are performed utilizing a maximum likelihood statistical operation.

Advantageously, the generation of the general value is performed utilizing a discriminant analysis procedure, and the speech attributes are speech classifiers.

Advantageously, the decision regions are defined by the mean of the unvoiced and voiced speech frames and a weight and threshold value generated in response to the general values of past and present frames and the means of the voiced and unvoiced frames.

The method for detecting the presence of a fundamental frequency in speech frames comprises the steps of: generating a general value in response to a set of classifiers defining speech attributes of a present speech frame to indicate the presence of the fundamental frequency, calculating a set of statistical parameters in response to the general value, and determining the presence of the fundamental frequency in response to the general value and the calculated set of statistical parameters. The step of generating the general value is performed utilizing a discriminant analysis procedure. Further, the step of determining the fundamental frequency comprises the step of calculating a weight and a threshold value in response to the set of parameters.

DETAILED DESCRIPTION

Figure 1:
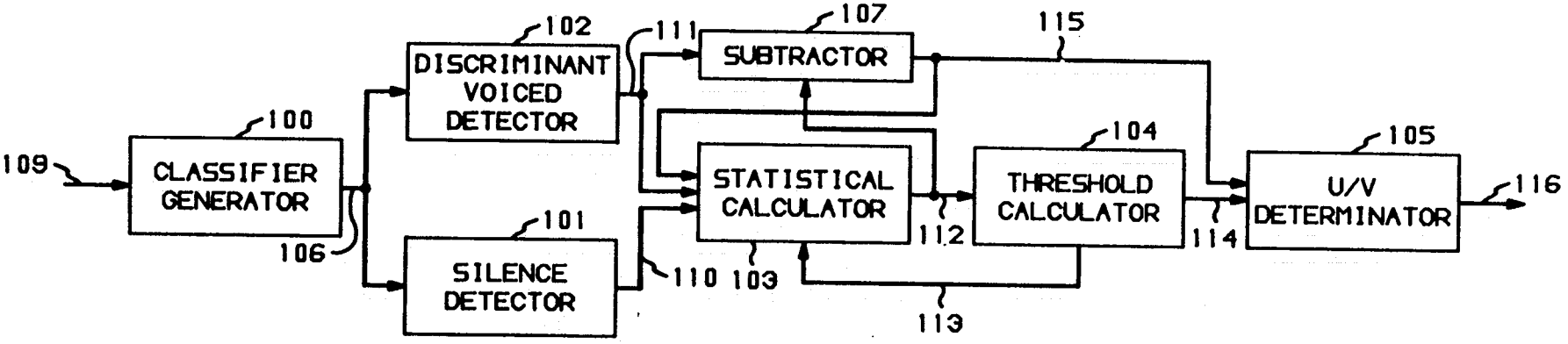
FIG. 1, in block diagram form, the present invention.

FIG. 1 illustrates an apparatus for performing the unvoiced/voiced decision operation by first utilizing a discriminant voiced detector to process voice classifiers in order to generate a discriminant variable or general variable. The latter variable is statistically analyzed to make the voicing decision. The statistical analysis adapts the threshold utilized in making the unvoiced/-voiced decision so as to give reliable performance in a variety of voice environments.

Consider now the overall operation of the apparatus illustrated in FIG. 1. Classifier generator 100 is responsive to each frame of voice to generate classifiers which advantageously may be the log of the speech energy, the log of the LPC gain, the log area ratio of the first reflection coefficient, and the squared correlation coefficient of two speech segments one frame long which are offset by one pitch period. The calculation of these classifiers involves digitally sampling analog speech, forming frames of the digital samples, and processing those frames and is well known in the art. In addition, Appendix A illustrates a program routine for calculating those classifiers. Generator 100 transmits the classifiers to silence detector 101 and discriminant voiced detector 102 via path 106. Discriminant voiced detector 102 is responsive to the classifiers received via path 106 to calculate the discriminant value, x. Detector 102 performs that calculation by solving the equation: $x=c'y+d$. Advantageously, "c" is a vector comprising the weights, "y" is a vector comprising the classifiers, and "d" is a scalar representing a threshold value. Advantageously, the components of vector c are initialized as follows: component corresponding to log of the speech energy equals 0.391.8606, component corresponding to log of the LPC gain equals −0.0520902, component corresponding to log area ratio of the first reflection coefficient equals 0.5637082, and component corresponding to squared correlation coefficient equals 1.361249; and d initially equals −8.36454. After calculating the value of the discriminant variable x, the detector 102 transmits this value via path 111 to statistical calculator 103 and subtracter 107.

Silence detector 101 is responsive to the classifiers transmitted via path 106 to determine whether speech is actually present on the data being received on path 109 by classifier generator 100. The indication of the presence of speech is transmitted via path 110 to statistical calculator 103 by silence detector 101.

For each frame of speech, detector 102 generates and transmits the discriminant value x via path 111. Statistical calculator 103 maintains an average of the discriminant values received via path 111 by averaging in the discriminant value for the present, non-silence frame with the discriminant values for previous non-silence frames. Statistical calculator 103 is also responsive to the signal received via path 110 to calculate the overall probability that any frame is unvoiced and the probability that any frame is voiced. In addition, statistical calculator 103 calculates the statistical value that the discriminant value for the present frame would have if the frame was unvoiced and the statistical value that the discriminant value for the present frame would have if the frame was voiced. Advantageously, that statistical value may be the mean. The calculations performed by calculator 103 are not only based on the present frame but on previous frames as well. Statistical calculator 103 performs these calculations not only on the basis of the discriminant value received for the present frame via path 106 and the average of the classifiers but also on the basis of a weight and a threshold value defining whether a frame is unvoiced or voiced received via path 113 from threshold calculator 104.

Calculator 104 is responsive to the probabilities and statistical values of the classifiers for the present frame as generated by calculator 103 and received via path 112 to recalculate the values used as weight value a, and threshold value b for the present frame. Then, these new values of a and b are transmitted back to statistical calculator 103 via path 113.

Calculator 104 transmits the weight, threshold, and statistical values via path 114 to U/V determinator 105. The latter detector is responsive to the information transmitted via paths 114 and 115 to determine whether or not the frame is unvoiced or voiced and to transmit this decision via path 116.

Consider now in greater detail the operations of blocks 103, 104, 105, and 107 illustrated in FIG. 1. Statistical calculator 103 implements an improved EM algorithm similar to that suggested in the article by N. E. Day entitled "Estimating the Components of a Mixture of Normal Distributions", Biometrika, Vol. 56, No. 3, pp. 463–474, 1969. Utilizing the concept of a decaying average, calculator 103 calculates the average for the discriminant values for the present and previous frames by calculating following equations 1, 2, and 3:

$$n=n+1 \text{ if } n<2000 \tag{1}$$

$$z=1/n \tag{2}$$

$$X_n=(1-z)\,X_{n-1}+zx_n \tag{3}$$

$x_n$ is the discriminant value for the present frame and is received from detector 102 via path 111, and n is the number of frames that have been processed up to 2000. z represents the decaying average coefficient, and $X_n$ represents the average of the discriminant values for the present and past frames. Statistical calculator 103 is responsive to receipt of the z, $x_n$ and $X_n$ values to calculate the variance value, T, by first calculating the second moment of $x_n$, $Q_n$, as follows:

$$Q_n=(1-z)\,Q_{n-1}+zn_n^2. \tag{4}$$

After $Q_n$ has been calculated, T is calculated as follows:

$$T=Q_n-x_n^2. \tag{5}$$

The mean is subtracted from the discriminant value of the present frame as follows:

$$x_n=x_n-x_n \tag{6}$$

Next, calculator 103 determines the probability that the frame represented by the present value $x_n$ is unvoiced by solving equation 7 shown below:

$$P(u|x_n) = \frac{1}{1+\exp(ax_n+b)}. \tag{7}$$

After solving equation 7, calculator 103 determines the probability that the discriminant value represents a voiced frame by solving the following:

$$P(v|x_n)=1-P(u|x_n). \tag{8}$$

Next, calculator 103 determines the overall probability that any frame will be unvoiced by solving equation 9 for $p_n$:

$$p_n=(1-z)p_{n-1}+z\,P(u|x_n)\,. \tag{9}$$

After determining the probability that a frame will be unvoiced, calculator 103 determines two values, u and v, which give the mean values of discriminant value for both unvoiced and voiced type frames. Value u, statistical average unvoiced value, contains the mean discriminant value if a frame is unvoiced, and value v, statistical average voiced value, gives the mean discriminant value if a frame is voiced. Value u for the present frame is solved by calculating equation 10, and value v is determined for the present frame by calculating equation 11 as follows:

$$u_n=(1-n)u_{n-1}+z\,x_n\,P(u|x_n)/p_n-zx_n \quad (10)$$

$$v_n=(1-n)v_{n-1}+z\,x_n\,P(v|x_n)/(1-p_n)-zx_n \quad (11)$$

Calculator 103 now communicates the u, v, and T values, and probability $p_n$ to threshold calculator 104 via path 112.

Calculator 104 is responsive to this information to calculate new values for a and b. These new values are then transmitted back to statistical calculator 103 via path 113. This allows rapid adaptations to changing environments. If n is greater than advantageously 99, values a and b are calculated as follows. Value a is determined by solving the following equation:

$$a = T^{-1}\frac{(v_n - u_n)}{1 - p_n(1 - p_n)\,T^{-1}(u_n - v_n)^2}. \quad (12)$$

Value b is determined by solving the following equation:

$$b=-\tfrac{1}{2}a(u_n+v_n)+\log[(1-p_n)/p_n] \quad (13)$$

After calculating equations 12 and 13, calculator 104 transmits values a, u, and v to block 105 via path 114.

Determinator 105 is responsive to this transmitted information to decide whether the present frame is voiced or unvoiced. If the value a is positive, then, a frame is declared voiced if the following equation is true:

$$ax_n-a(u_n+v_n)/2>0\,; \quad (14)$$

or if the value a is negative, then, a frame is declared voiced if the following equation is true:

$$ax_n-a(u_n+v_n)/2<0\,. \quad (15)$$

Equation 14 can also be expressed as:

$$ax_n+b-\log[(1-p_n)/p_n]>0\,.$$

Equation 15 can also be expressed as:

$$ax_n+b-\log[(1-p_n)/p_n]<0\,.$$

If the previous conditions are not met, determinator 105 declares the frame unvoiced.

Figure 2:
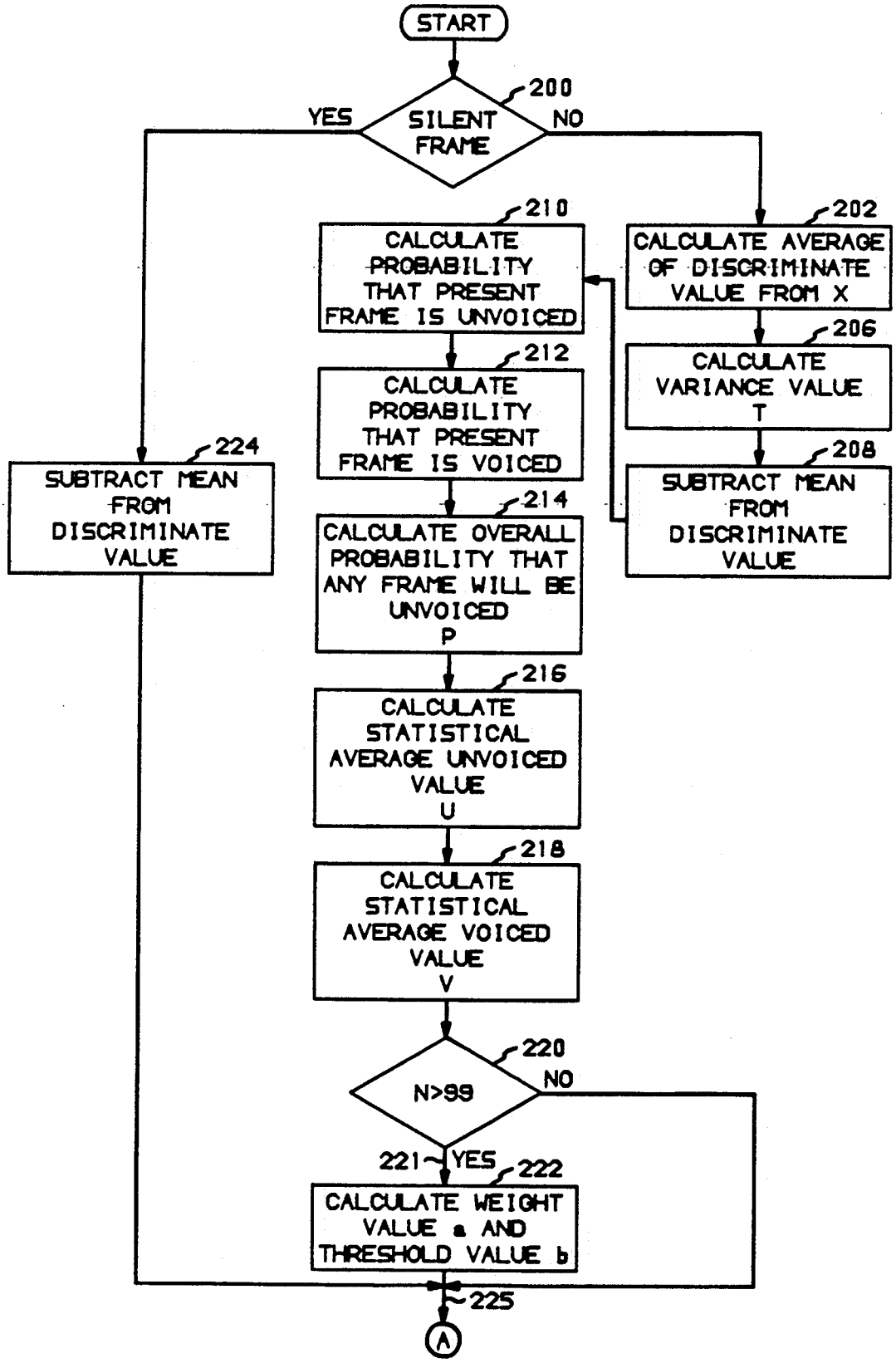
FIGS. 2 and 3 illustrate, in greater detail, certain functions performed by the voiced detection apparatus of FIG. 1.
Figure 3:
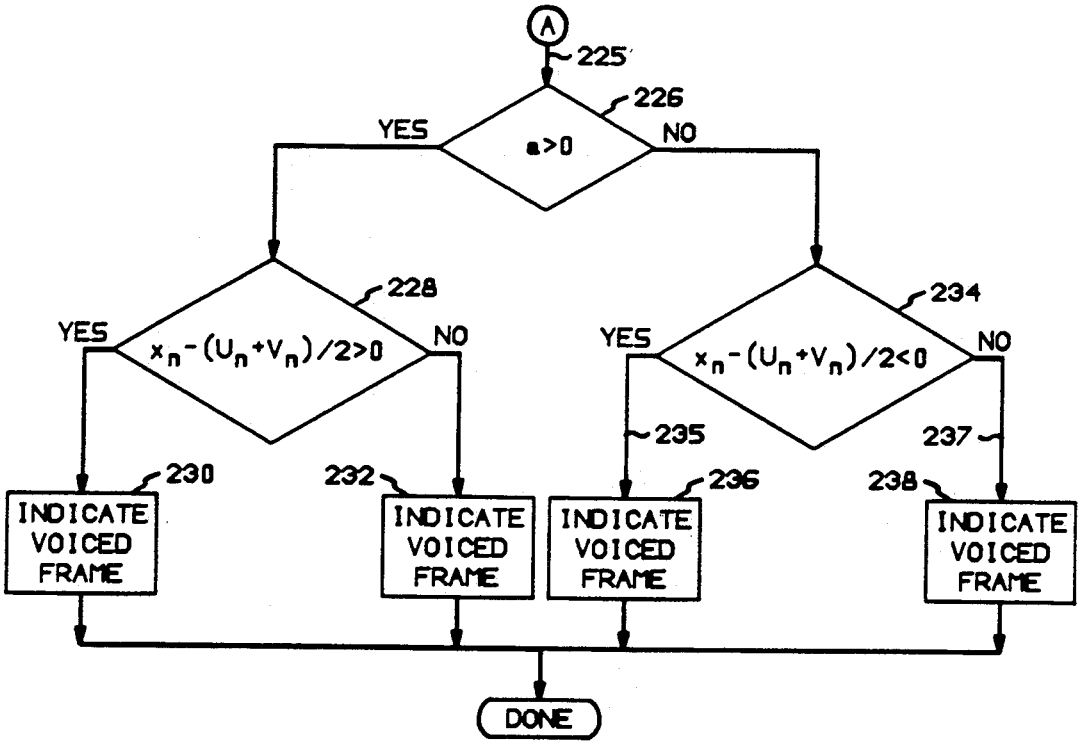

In flow chart form, FIGS. 2 and 3 illustrate, in greater detail, the operations performed by the apparatus of FIG. 1. Block 200 implements block 101 of FIG. 1. Blocks 202 through 218 implement statistical calculator 103. Block 222 implements threshold calculator 104, and blocks 226 through 238 implement block 105 of FIG. 1. Subtracter 107 is implemented by both block 208 and block 224. Block 202 calculates the value which represents the average of the discriminant value for the present frame and all previous frames. Block 200 determines whether speech is present in the present frame; and if speech is not present in the present frame, the mean for the discriminant value is subtracted from the present discriminant value by block 224 before control is transferred to decision block 226.

However, if speech is present in the present frame, then the statistical and weight calculations are performed by blocks 202 through 222. First, the average value is found in block 202. Second, the second moment value is calculated in block 206. The latter value along with the mean value X for the present and past frames is then utilized to calculate the variance, T, also in block 206. The mean X is then subtracted from the discriminant value $x_n$ in block 208.

Block 210 calculates the probability that the present frame is unvoiced by utilizing the current weight value a, the current threshold value b, and the discriminant value for the present frame, $x_n$. After calculating the probability that the present frame is unvoiced, the probability that the present frame is voiced is calculated by block 212. Then, the overall probability, $p_n$, that any frame will be unvoiced is calculated by block 214.

Blocks 216 and 218 calculate two values: u and v. The value u represents the statistical average value that the discriminant value would have if the frame were unvoiced. Whereas, value v represents the statistical average value that the discriminant value would have if the frame were voiced. The actual discriminant values for the present and previous frames are clustered around either value u or value v. The discriminant values for the previous and present frames are clustered around value u if these frames had been found to be unvoiced; otherwise, the previous values are clustered around value v. Block 222 then calculates a new weight value a and a new threshold value b. The values a and b are used in the next sequential frame by the preceding blocks in FIG. 2.

Blocks 226 through 238 implement U/V determinator 105 of FIG. 1. Block 226 determines whether the value a for the present frame is greater than zero. If this condition is true, then decision block 228 is executed. The latter decision block determines whether the test for voiced or unvoiced is met. If the frame is found to be voiced in decision block 228, then the frame is so marked as voiced by block 230 otherwise the frame is marked as unvoiced by block 232. If the value a is less than or equal to zero for the present frame, blocks 234 through 238 are executed and function in a similar manner to blocks 228 through 232.

A routine for implementing generator 100 of FIG. 1 is illustrated in Appendix A, and another routine that implements blocks 102 through 105 of FIG. 1 is illustrated in Appendix B. The routines of Appendices A and B are intended for execution on a Digital Equipment Corporation's VAX 11/780-5 computer system or a similar system.

It is to be understood that the afore-described embodiment is merely illustrative of the principles of the invention and that other arrangements may be devised by those skilled in the art without departing from the spirit and the scope of the invention.

```
/*classifier generator.  print classifiers to stdout.*/
#include <stdio.h>
#include <math.h>

main(argc,argv)
short argc;
char *argv[];
{
short i,j,m,L,N;
long counter;
short fid1,nn[1]; /*File identifiers and 1 byte storage*/
float corr(),storecorr;
int maxi[7];
float bdR[200],eR[200],extraR[15];
int isi[1000];          /*(isignal) Four frames of speech on [0,4L-1]*/
float stepR,stepdR;
float S1,S2,R,RR;
float Power[7],POWER[7]; /*spch Power, res POWER*/
float coeff[10][15];
if(argc < 3)
{   printf("usage: classgen speechfile L > 4pars\n");
    exit(1);
}
if((fid1=open(argv[1],0))== -1)
{
    printf("Cannot open %s\n",argv[1]);
    exit(1);
}
counter=1;      /*frame counter*/
L=atoi(argv[2]);            /*frame length in 8KHz samples*/
N=10;           /*LPC filter order*/
m=0;    /*inframe counter*/
while( read(fid1,nn,2) == 2 )
{   m=m+1;
    if(m==1) Power[1]=0.0;
    Power[1]=Power[1] + (float)nn[0]*(float)nn[0];
    RR=eR[m+N-1]=bdR[m+N]=nn[0];
    isi[3*L+m-1]=nn[0];/*Put in frame 4, use when data reaches frame 2*/
    if( m >= L-(N-1) ) extraR[m-(L-N)]=RR;
    if( m%L == 0)
    {   for(j=1;j<=N;++j)
        {   S1=0.0;
            S2=0.0;
            for(i=N;i<=L+N-1;++i)
            {   S1=S1+eR[i]*eR[i]+bdR[i]*bdR[i];
                S2=S2+eR[i]*bdR[i];
            }
            if(S1 == 0.0) coeff[1][j] = 0.0;
            else coeff[1][j] = -2.0*S2/S1;

            for(i=1;i<=L+N-1;++i)
            {   R=eR[i]+bdR[i]*coeff[1][j];
                stepR=bdR[i]+eR[i]*coeff[1][j];
                eR[i]=R;
                bdR[i]=stepdR;
                stepdR=stepR;
            }
        } /*j=1,N*/

        POWER[1]=0.0;
        for(i=1;i<=L;++i) POWER[1]=POWER[1]+eR[i+N-1]*eR[i+N-1];

        bdR[1]=extraR[1];
        for(i=1;i<=N-1;++i) eR[i]=bdR[i+1]=extraR[i+1];

        if(counter>2)
        {   maxi[2]=maxi[1];
            storecorr=corr(&maxi[1],isi,L);         /*loads maxi[1]*/
            maxi[0]=abs(maxi[2]-maxi[1]);
            printf("%f ",log(Power[3]));          /*log speech Power*/
            printf("%f ",log(Power[3]/POWER[3])); /*Pp - log LPC gain*/
            printf("%f ",log((1-coeff[3][1])/(1+coeff[3][1]))); /*LAR1*/
            printf("%f ",storecorr );             /*cordata or rhomax*/
            printf("\n");
        } /*counter>2*/
        m=0;
        counter=counter+1;
        for(i=0;i<3*L;i++) isi[i]=isi[i+L];
        for(j=4;j>1;j=j-1) for(i=1;i<=N;++i) coeff[j][i]=coeff[j-1][i];
        for(j=5;j>1;j=j-1){
            POWER[j]=POWER[j-1];
            Power[j]=Power[j-1];
        }
    }
}
```

```
}/*main*/

float corr(maxi,isi,L)  /*Find max corr_coef^2 of frame [L,2*L-1]*/
int *maxi;
int isi[];
short L;
{   float cora,corb,corc,corcof,max= -1;
    short i,j,Li2;
    for(i=20;i<L;i++) /*Try all pitches > 20 and < L*/
    {   Li2 = L - i/2;
        cora=corb=corc=0.0;
        for(j=0;j<L;j++)
        {   cora += isi[Li2+j]   * isi[Li2+j];
            corb += isi[Li2+i+j] * isi[Li2+i+j];
            corc += isi[Li2+j]   * isi[Li2+i+j];
        }
        if(corc==0.0) cora=corb=1.0; /*divide by 0 protection*/
        corcof = corc*corc/(cora*corb);
        if(corcof>max)
        {   max = corcof;
            *maxi = i;
        }
    }
    return(max);
}
```

```
/*Performs clustering on D floating ASCII parameters*/
#include <stdio.h>
#include <math.h>
#define K 4     /*Number of different weight vectors to select from*/
#define D 4     /*Number of classifiers*/

main(argc,argv)
int argc;
char *argv[];
{   float cluster(),fixed(),thresh(),lopass();
    int mahal();
    float z[D][1],M[K],d[K];
    int max,speech;
    static long frameno=0;

    if(argc>1)
        {printf("usage:  %s < par.list (54.s.4pars)\n",argv[0]); exit(1);}
    while(1==1)
    {   frameno++;
        if(scanf("%f%f%f%f",
            &z[0][0],&z[1][0],&z[2][0],&z[3][0])==EOF)exit();
        d[0]=fixed(z);
        d[1]=lopass(z);
        d[2]=thresh(z);
        d[3]=cluster(&speech,z);
        if(speech==1) max=mahal(M,d);
        if(d[max]>0) printf("1 ");  /*Declare frame voiced*/
        else printf("0 ");          /*Declare frame unvoiced*/
        printf("\n");
    }
}
int mahal(M,d)  /*return index of largest mahalanobis distance.*/
float M[],d[];
{   static float u0[K],s0[K],v0[K],u1[K],s1[K],v1[K],p[K];
    float alpha;
    static int N=0;
    int i,max;
    if(N<200) N++;
    alpha=1.0/(float)N;
    for(i=0;i<K;i++)
```

```
        {   if(fabs(d[i])<50.0) /*limit transient divergence*/
            {   if(d[i]<0) /*if unvoiced*/
                {   p[i] = (1-alpha)*p[i] + alpha;/*p is prob of unvoiced*/
                    u0[i] = (1-alpha)*u0[i] + alpha*d[i];
                    s0[i] = (1-alpha)*s0[i] + alpha*d[i]*d[i];
                    v0[i] = s0[i] - u0[i]*u0[i];
                }
                else /*if voiced*/
                {   p[i] = (1-alpha)*p[i];
                    u1[i] = (1-alpha)*u1[i] + alpha*d[i];
                    s1[i] = (1-alpha)*s1[i] + alpha*d[i]*d[i];
                    v1[i] = s1[i] - u1[i]*u1[i];
                }
            }
            if(p[i]*v0[i]+(1-p[i])*v1[i] > 0.0)
                M[i] = (u0[i]-u1[i])*(u0[i]-u1[i])/(p[i]*v0[i] +
                        (1-p[i])*v1[i]);
        }
        for(max=0,i=1;i<K;i++) if(M[i]>M[max]) max=i;
        return(max);
    }
    float thresh(y) /*statistical and threshold calculator*/
    float y[D][1]; /*y[0][0] is log(Power)*/
    {   void invert(), matmult(), transpose(), sum();
        static float a,u1,u2;
        static float z,zbar;
        static float Q,T;
        static float b,p,p1z,p2z;
        static float powermin,freezeframe=0;
        static long frameno=0,N=0;
        float alpha,dscr;
        float fixed();

        frameno++;                                          /*frame counter*/
        z=fixed(y);          /*Find discriminant variable from weighted sum*/
        if(N==0)
        {   a = 1.0;
            b = 0.0;
            p = 0.5;
        }
        if(freezeframe<20 && y[0][0]>9) freezeframe++;
        if(freezeframe==2 && y[0][0]>9) powermin=y[0][0]; /*init*/
        else if(freezeframe>0)
        {   if(powermin<y[0][0]) powermin += 0.02/freezeframe;
            else    powermin -= 0.98/freezeframe;
        }
        if(y[0][0]-log(10.0)>powermin)                      /*Silence detector*/
        {   if(N<100) N++;
            alpha = 1.0/(float)N;
            zbar = (1-alpha)*zbar + alpha*z;
            Q = (1-alpha)*Q + alpha*z*z;
            T = Q - zbar*zbar;
            z = z - zbar;
            if(a*z+b>70) p1z=0;
                else p1z = 1/(1 + exp(a*z+b));
            if(N==1) p1z=0.5;
            p2z = 1 - p1z;
            p = (1-alpha)*p + alpha*p1z;
            u1 = (1-alpha)*u1 + alpha*z*p1z/p - alpha*z;
            u2 = (1-alpha)*u2 + alpha*z*p2z/(1-p) - alpha*z;
            if( N>99 )
            {   a = (u2-u1)/( T-p*(1-p)*(u2-u1)*(u2-u1) );
            }
            b = -0.5*a*(u2+u1) + log((1-p)/p);
        }   /*Silence detector*/
        else
            z = z - zbar;
        dscr = z - 0.5*(u2+u1);
        if(a<0) dscr= -dscr;                /*loudest cluster is voiced*/
        fflush(stdout);
        return(dscr);        /*Voiced iff dscr > 0.0*/
    }
    float fixed(z) /*discriminant analysis for normal speech*/
    float z[D][1];
    {   return(z[0][0]  *  0.3918606 +
               z[1][0] * -0.0520902 +
               z[2][0] *  0.5637082 +
               z[3][0] *  1.361249  +
```

```
139                 - 8.36454);
140     }
141     float lopass(z) /*discriminant analysis for low pass filtered speech*/
142     float z[D][1]; /*z[0][0] is log(Power)*/
143     {   return(z[0][0]  *  0.3199999 +
144                 z[1][0] *  0.2897963 +
145                 z[2][0] * -0.1820704 +
146                 z[3][0] *  1.636398 +
147                 - 7.23397);
148     }
149     float cluster(speech,safez) /*Statistical voiced detector*/
150     int *speech;    /*returns silence decision:  0=silence, 1=speech*/
151     float safez[D][1]; /*safez[0][0] is log(Power)*/
152     {   void invert(), matmult(), transpose(), sum();
153         static float a[D][1],u1[D][1],u2[D][1];
154         static float zbar[D][1];
155         static float Q[D][D],T[D][D],Tinv[D][D];
156         static float b,p,p1z,p2z;
157         static float powermin,freezeframe=0;
158         static long frameno=0,N=0;
159         float z[D][1];
160         float u1mu2[D][1],u2mu1[D][1],u1pu2[D][1],vector[D][1];
161         float trans[1][D],matrix[D][D];
162         float alpha,beta,scalar,dscr;
163
164         sum(z,safez,safez,0.0,1.0,D,1); /*copy safez to z*/
165         frameno++;/*frame counter*/
166         if(N==0)
167         {   a[0][0]= -0.3918606; /*Start at discriminant values*/
168             a[1][0]=  0.0520902;
169             a[2][0]= -0.5637082;
170             a[3][0]= -1.361249;
171             b = 8.36454;
172             p = 0.5;
173         }
174         if(freezeframe<20 && z[0][0]>9) freezeframe++;
175         if(freezeframe==2 && z[0][0]>9) powermin=z[0][0]; /*init*/
176         else if(freezeframe>0)
177         {   if(powermin<z[0][0]) powermin += 0.02/freezeframe;
178             else    powermin -= 0.98/freezeframe;
179         }
180         if(z[0][0]-log(10.0)>powermin)                  /*Silence detector*/
181         {   *speech=1;
182             if(N<2000) N++;
183             alpha = 1.0/(float)N;
184             beta = 1.0 - alpha;
185             sum(zbar,zbar,z,beta,alpha,D,1);        /*  Find zbar          */
186             transpose(trans,z,D,1);                 /*  Find T:  START     */
187             matmult(matrix,z,trans,D,1,D);          /*  matrix = z%*t(z)   */
188             sum(Q,Q,matrix,beta,alpha,D,D);         /*                     */
189             transpose(trans,zbar,D,1);              /*                     */
190             matmult(matrix,zbar,trans,D,1,D);       /*  matrix = v%*t(v)   */
191             sum(T,Q,matrix,1.,-1.,D,D);             /*  T = Q - v%*t(v)    */
192             sum(z,z,zbar,1.,-1.,D,1);               /*  z+ = z - z_        */
193             transpose(trans,a,D,1);
194             matmult(vector,trans,z,1,D,1);          /* vector = t(a) %* z */
195
196
197
198
199
200
201
202
203
204
205
206
207             scalar = vector[0][0] + b;              /* scalar = t(a)%*z+b */
208             if(scalar>70)   p1z=0;
209                 else        p1z=1/(1 + exp(scalar));
210             if(N==1) p1z=0.5;
211             p2z = 1.0 - p1z;
212             p = beta*p + alpha*p1z;
213             sum(u1,u1,z,beta,alpha*p1z/p - alpha,D,1);
214             sum(u2,u2,z,beta,alpha*p2z/(1.0 - p) - alpha,D,1);
215             if( N>99 )
216             {   invert(Tinv,T,D);
217                 sum(u1mu2,u1,u2,1.,-1.,D,1);        /*u1mu2 = u1 - u2  */
218                 sum(u2mu1,u2,u1,1.,-1.,D,1);        /*u2mu1 = u2 - u1  */
219                 matmult(vector,Tinv,u1mu2,D,D,1);   /*v = Tinv %* u1mu2*/
220                 transpose(trans,u1mu2,D,1);
221                 matmult(vector,trans,vector,1,D,1); /*v=t(u1mu2)T%*u1mu2*/
222                 scalar = 1.0/(1 - p*(1-p)*vector[0][0]);
223                 matmult(vector,Tinv,u2mu1,D,D,1);       /*v=-Tinv(u2-u1)*/
224                 sum(a,vector,vector,0.,scalar,D,1); /*a <- .../(...)*/
225             }   /*N>*/
226             sum(u1pu2,u1,u2,1.,1.,D,1);         /******FIND B***********/
227             transpose(trans,a,D,1);
228             matmult(vector,trans,u1pu2,1,D,1);  /*vector = t(a)%*(u1+u2)*/
229             b = -0.5*vector[0][0] + log((1-p)/p);
```

```
230         }   /*Silence detector*/
231         else
232         {   *speech=0;
233             sum(z,z,zbar,1.,-1.,D,1);                /*  z+ = z - z_    */
234         }
235         transpose(trans,a,D,1);
236         matmult(vector,trans,z,1,D,1);
237         dscr = vector[0][0] + b - log((1-p)/p); /*Maximum likelihood est.*/
238         if(u2[0][0]-u1[0][0]<0) dscr= -dscr;    /*louder cluster is voiced*/
239         fflush(stdout);
240         return(dscr);       /*Voiced iff dscr > 0.0*/
241     }
242     /*A (n X n) is indexed from 0 to n-1*/
243     void invert(B,A,n)      /* B <- inverse(A)              */
244     float A[],B[];          /* A and B may be same array    */
245     long n;
246     {
247         long i;
248         long j;
249         long k;
250         long m;
251         long q;
252         float s;
253         float t;
254         float x[25];    /* needs order of matrix as dimension   */
255         float a[25*25]; /* needs (order^2+1)/2 of matrix as dimension   */
256
257         for(i=1;i<=n;i++)   /*Copy A[][] to a[]*/
258             for(j=1;j<=i;j++)
259                 a[i*(i-1)/2 + j] = A[n*(i-1)+(j-1)]; /*A[i][j]==A[n*i+j]*/
260         for( k=n; k>=1; k--){
261             s = a[1];
262             if( s <= 0.0){
263                 printf("singular matrix=%f\n",s);
264                 exit(1);
265             }
266             else{
267                 m = 1;
268                 for( i=2; i<=n ; i++){
269                     q = m;
270                     m = m + i;
271                     t = a[q + 1];
272                     x[i] = -t / s;
273                     if( i>k ) {
274                         x[i] = -x[i];
275                     }
276                     for( j=(q+2); j<=m; j++){
277                         a[j - i] = a[j] + t * x[j - q];
278                     }
279                 }
280                 q = q - 1;
281                 a[m] = 1.0 / s;
282                 for( i=2; i<=n; i++){
283                     a[q + i] = x[i];
284                 }
285             }
286         }/*k*/
287
288         for(i=1;i<=n;i++)   /*Copy a[] to B[][]*/
289             for(j=1;j<=i;j++)
290                 B[n*(i-1)+(j-1)] = a[i*(i-1)/2 + j]; /*B[i][j]==B[n*i+j]*/
291
292         for(i=0;i<n;i++)    /*Copy bottom half of B[][] to top*/
293             for(j=0;j<i;j++)
294                 B[j*n+i]=B[i*n+j];  /*B[j,i]=B[i,j]*/
295     }
296
297
298
299
300
301
302
303
304
305
306
307
308
309     void transpose( at, a, dim1, dim2)
310
311     float a[];  /* dim1 X dim2 matrix        */
312     float at[]; /* transposed output of a    */
313     long dim1;
314     long dim2;
315     {
316         long i;
317         long j;
318         long offset2;
319         long offset1;
320
321         offset2 = 0;
322         for(i=0; i<dim1; i++){
```

```
            offset1 = 0;
            for(j=0; j<dim2; j++){
                at[i+offset1] = a[j+offset2];
                offset1 += dim1;
            }
            offset2 += dim2;

        }
    }
    /*****************************************************************/
    /*      matmult( A, B, C, dimm, dimn, dimr)                      */
    /*                                                               */
    /*      C(dimmxdimr) = A(dimmxdimn) x B(dimnxdimr)               */
    /* note : notation is A[i,j] = A[dimn*i+j]                       */
    /*      UNIX V:  a[i][j]==a[0][n*i+j] (a is m X n).              */
    /*      C[i,j]=sum(from 0 to dimn-1) A[i,k]*B[k,j]               */
    /*****************************************************************/
    /*NOTE A & C, and B & C must be different unless C is 1 X 1*/

    void matmult( C, A, B, dimm, dimn, dimr)
    float A[],B[],C[];
    long dimm,dimn,dimr;
    {   long i,j,k;
        float sum;
        for(i=0;i<dimm;i++)
            for(j=0;j<dimr;j++) /*sweep C[i,j]*/
            {   sum=0.0;
                for(k=0;k<dimn;k++)
                    sum += A[dimn*i+k]*B[dimr*k+j];
                C[dimr*i+j]=sum;
            }
    }   /*Worked first time!*/
    /*UNIX V:  a[i][j]==a[0][n*i+j] (a is m X n).*/
    void sum(c,a,b,w1,w2,m,n)          /*  weighted sum of two matrices    */
    float a[],b[],c[],w1,w2;           /*  c = w1*a + w2*b                 */
    long m,n;                          /*  a, b, and c are m X n           */
    {   long i,j;
        for(i=0;i<m;i++)
            for(j=0;j<n;j++) c[n*i+j] = w1*a[n*i+j] + w2*b[n*i+j];
    }
```

What is claimed is:

1. An apparatus for detecting the presence of a fundamental frequency in frames of speech, comprising:

means responsive to a set of classifiers defining speech attributes of one of said frames of speech for generating a general value indicating said presence of said fundamental frequency;

means responsive to said general value for calculating a set of statistical parameters;

means for calculating a threshold value in response to said set of said parameters;

means for calculating a weight value in response to said set of said parameters;

means for communicating said weight value and said threshold value to said means for calculating said set of parameters to be used for calculating another set of parameters for another one of said frames of speech; and means responsive to said weight value and said threshold value and the calculated set of statistical parameters for determining said presence of said fundamental frequency in said present one of said frames of speech.

2. The apparatus of claim 1 wherein said generating means comprises means for performing a discriminant analysis to generate said general value.

3. The apparatus of claim 2 wherein said means for calculating said set of parameters further responsive to the communicated weight value and threshold value and another general value of said other one of said frames for calculating another set of statistical parameters.

4. The apparatus of claim 3 wherein said means for calculating said set of parameters further comprises means for calculating the average of said general values over said present and previous ones of said speech frames; and means responsive to said average of said general values for said present and previous ones of said speech frames and said communicated weight value and threshold value and said other general value for determining said other set of statistical parameters.

5. An apparatus for detecting the presence of a fundamental frequency in frames of non-training set speech, comprising:

means responsive to a set of classifiers defining speech attributes of each of a present and past ones said frames of non-training set speech for generating a general value indicating said presence of said fundamental frequency;

means for calculating the variance of said general values over said present and previous ones of said speech frames;

means responsive to present and past ones of said frames for calculating the probability that said present one of said frames is unvoiced;

means responsive to said present and past ones of said frames and said probability that said present one of said frames is unvoiced for calculating the overall probability that any frame will be unvoiced;

means for calculating the probability that said present one of said frames is voiced;

means responsive to said probability that said present one of said frames is unvoiced and said overall probability and said variance for calculating a mean of said unvoiced ones of said frames;

means responsive to said probability that said present one of said frames is voiced and said overall probability and said variance for calculating a mean of said voiced ones of said frames;

means responsive to said mean for unvoiced ones of said frames and said mean of voiced ones of said frames and said variance for determining decision regions; and means for making the determination of said presence of said fundamental frequency in response to said decision regions for said present one of said frames.

6. The apparatus of claim 5 wherein said means for calculating said probability that said present one of said frames is unvoiced performed a maximum likelihood statistical operation.

7. The apparatus of claim 6 wherein said means for calculating said probability that said present one of said frames is unvoiced further responsive to a weight value and threshold value to perform said maximum likelihood statistical operation.

8. A method for detecting the presence of a fundamental frequency in frames of speech comprising the steps of:

generating a general value in response to a set of classifiers defining speech attributes of one of said frames of speech to indicate said presence of said fundamental frequency;

calculating a set of statistical parameters in response to said general value; and determining said presence of said fundamental frequency in said one of said frames;

said step of determining comprises the steps of calculating a threshold value in response to said set of said parameters;

calculating a weight value in response to said set of said parameters; and communicating said weight value and said threshold value to said means for calculating said set of parameters to be used for calculating another set of parameters for another one of said frames of speech.

9. The method of claim 8 wherein said step of generating comprises the step of performing a discriminant analysis to generate said general value.

10. The method of claim 9 wherein said step of calculating said set of parameters further responsive to the communicated weight and threshold value and another general value of said other one of said frames for calculating another set of statistical parameters.

11. The method of claim 10 wherein said step of calculating said set of parameters further comprises the steps of calculating the average of said general values over said present and previous ones of said speech frames; and determining said other set of statistical parameters in response to said average of said general values for said present and previous ones of said speech frames and said communicated weight and threshold value and said other general values.

* * * * *